US005121556A

United States Patent [19]

Moore et al.

[11] Patent Number: 5,121,556

[45] Date of Patent: Jun. 16, 1992

[54] ADJUSTABLE BOLT CIRCLE LAYOUT APPARATUS

[76] Inventors: Samuel A. Moore; Glennie F. Moore, both of Rte. 1 Box 71 Alesia Dr., East Prairie, Mo. 63845

[21] Appl. No.: 742,325

[22] Filed: Aug. 8, 1991

[51] Int. Cl.[5] ..... B25H 7/00

[52] U.S. Cl. ..... 33/673

[58] Field of Search ..... 33/670, 669, 666, 578, 33/673

[56] References Cited

U.S. PATENT DOCUMENTS 575,469 1/1897 Fancher ..... 33/673 X 589,872 9/1897 Stratton et al. ..... 33/673

*Primary Examiner*—Harry N. Haroian

*Attorney, Agent, or Firm*—Leon Gilden

[57] ABSTRACT

An apparatus includes a base plate, with a series of convex slots oriented in a clockwise array through the base plate, and a top plate including a clockwise array of concave slots, wherein the convex slots and concave slots are each of a predetermined number and each pair of overlying concave and convex slots includes a layout spool interconnecting the slots, wherein the spools are directed radially, interiorly, and outwardly of a central opening within the base plate and top plate. A graduated clamp ring mounted to the base plate is positioned exteriorly of the top plate, with a central knob mounted to the top plate to effect rotation of the top plate relative to the base plate.

6 Claims, 6 Drawing Sheets

Fig 2
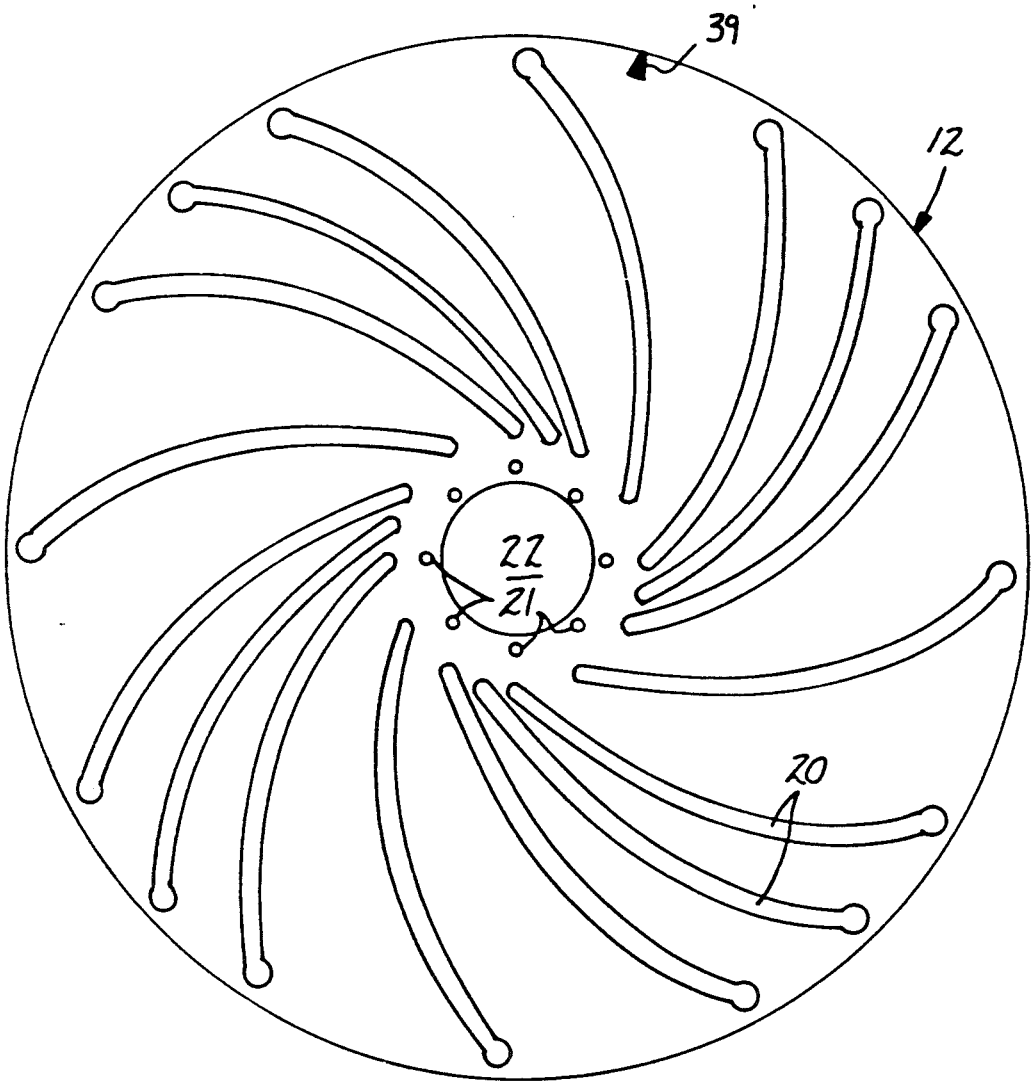
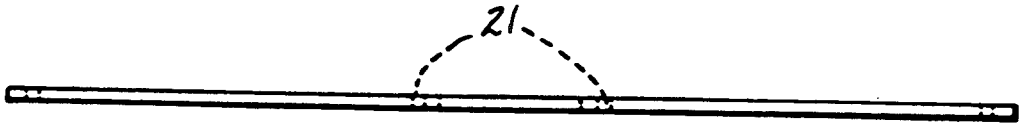
Fig 3

FIG 4
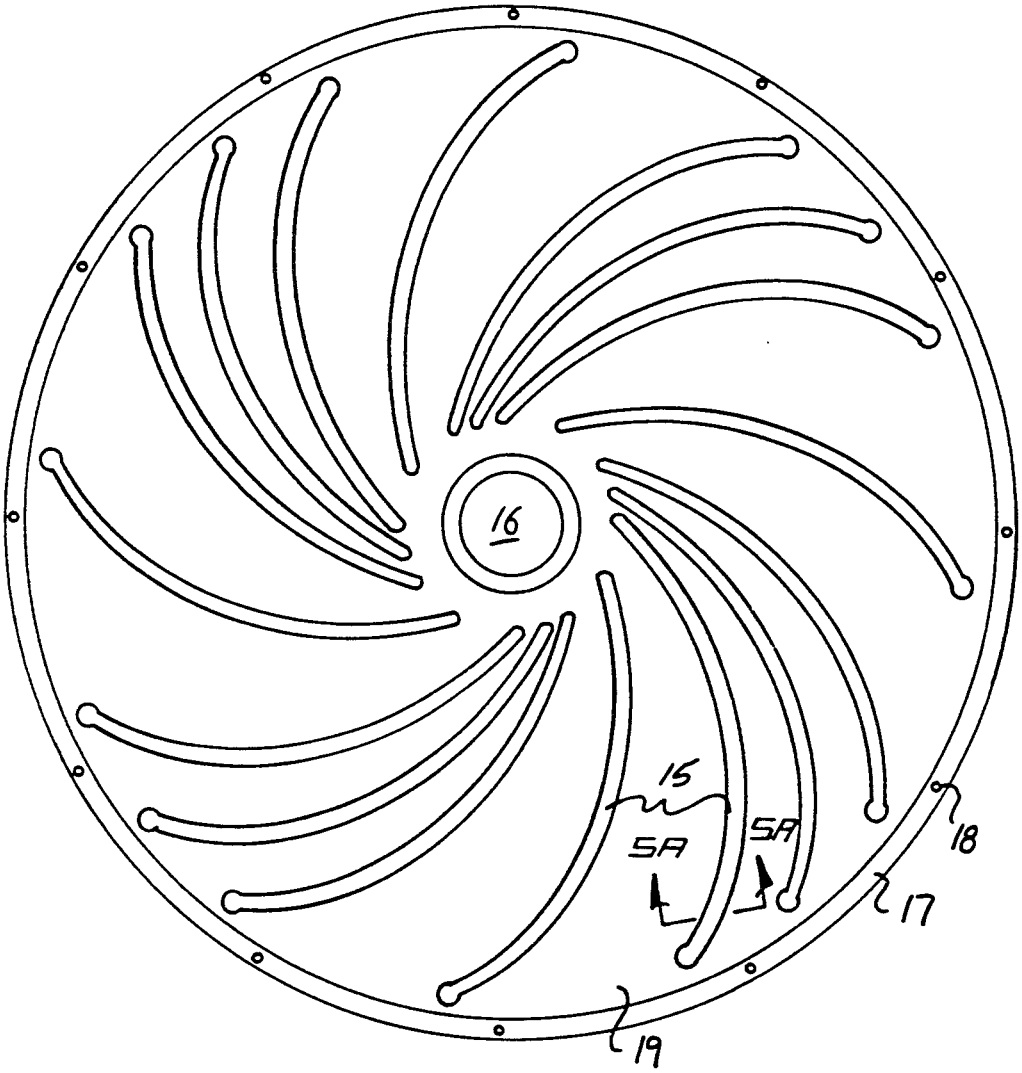
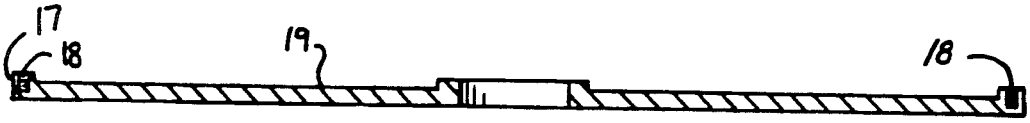
FIG 5
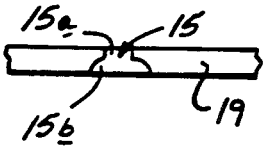
FIG 5A

FIG 6
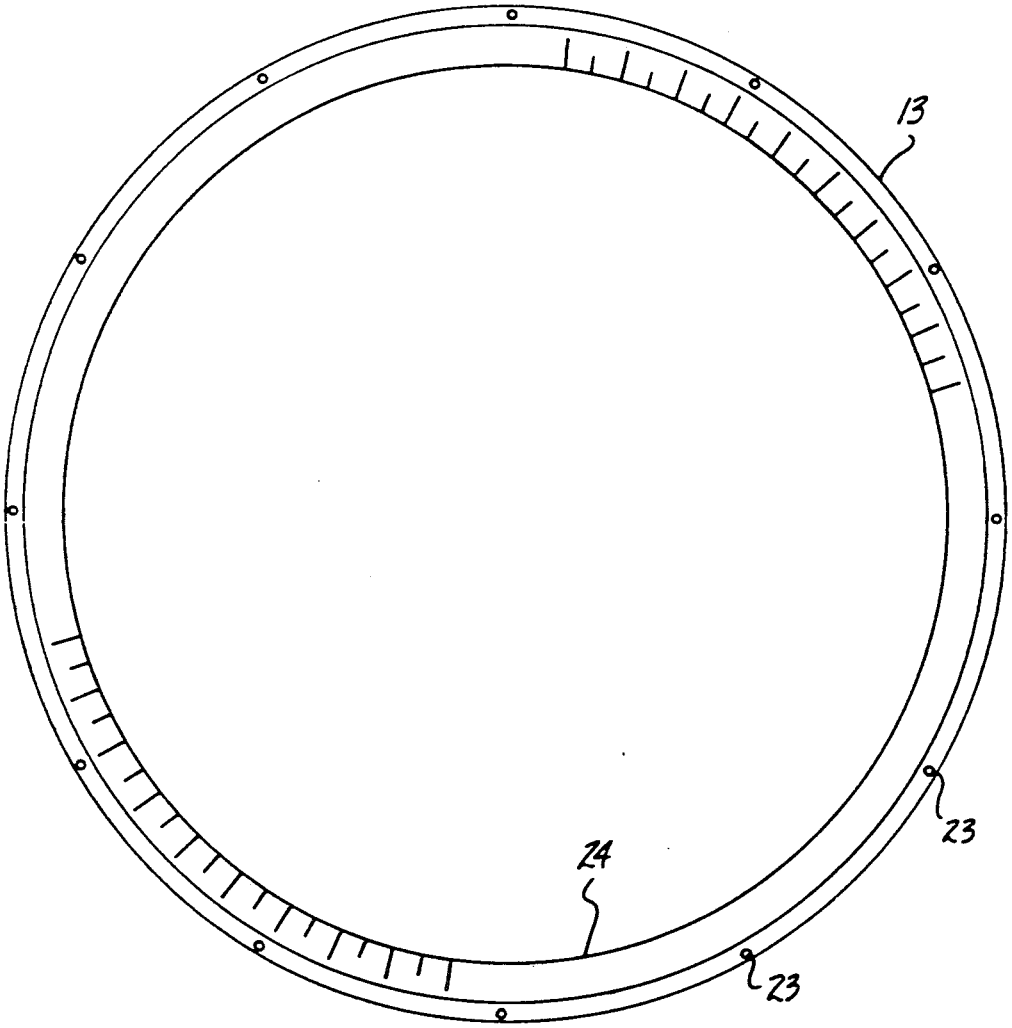
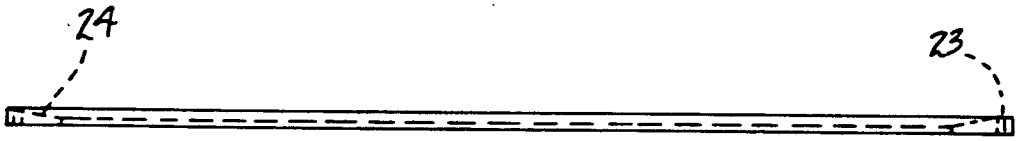
FIG 7

Fig 8
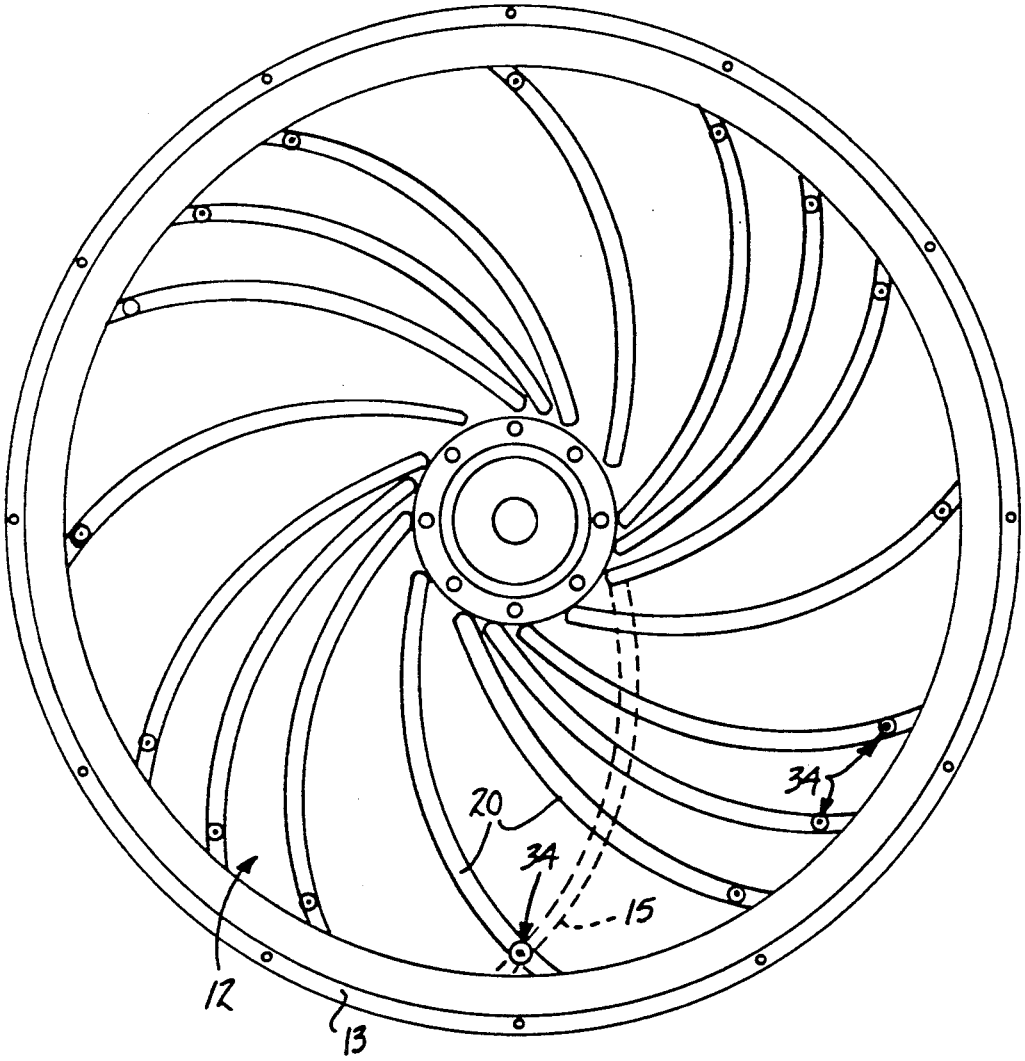
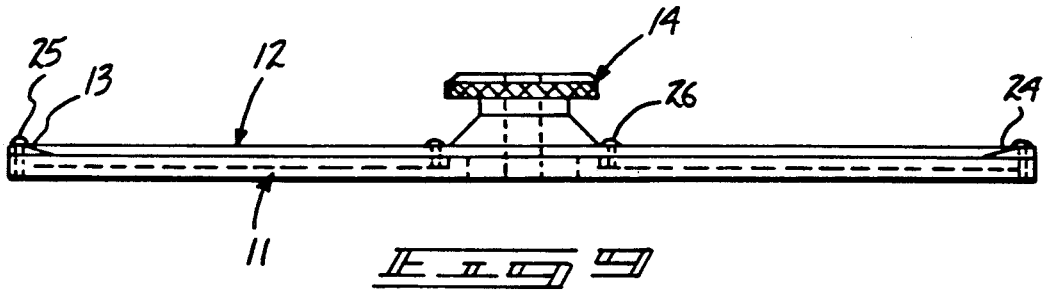
Fig 9

Fig 10
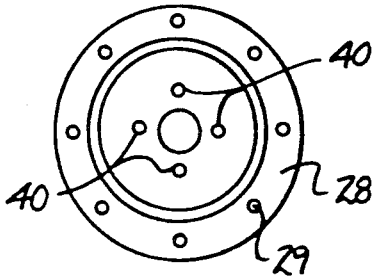
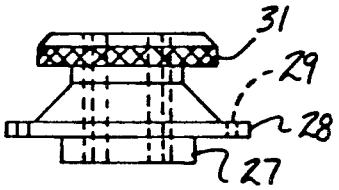
Fig 11
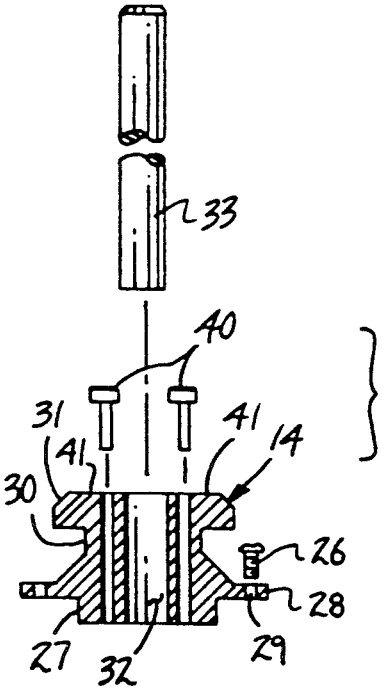
Fig 12
Fig 13
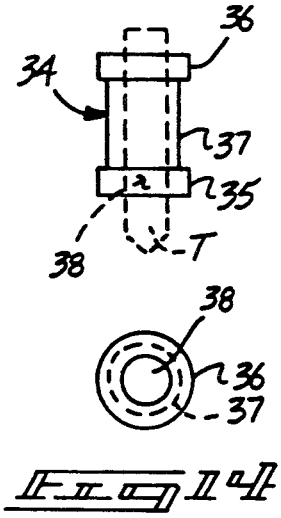
Fig 14

ADJUSTABLE BOLT CIRCLE LAYOUT APPARATUS

BACKGROUND OF THE INVENTION

1. Field of the Invention

The field of invention relates to layout tool structure, and more particularly pertains to a new and improved adjustable bolt circle layout apparatus wherein the same is arranged for orienting a bolt circle pattern at various radial distances from a central axial position.

2. Description of the Prior Art

Various layout tool structure has been utilized in the prior art for providing a layout of various measurements relative to a workpiece. For example, U.S. Pat. No. 4,228,594 to Shlager sets forth a layout tool for locating holes in structural steel wherein the tool is positionable within an "I" beam channel to position and orient holes relative to the "I" beam channel.

U.S. Pat. No. 4,706,972 to Kormos sets forth an expandable arbor for locating an axis of an internal bore or surface.

U.S. Pat. No. 4,392,307 to Wightman, Jr. sets forth a face plate template to establish a predetermined size recess for a face plate of a door latch or lock.

U.S. Pat. No. 4,928,399 to Kragt sets forth a marking template arranged for positioning a marker tool to define positions of cuts and holes to be made into an underlying workpiece.

U.S. Pat. No. 4,257,166 to Barker sets forth an adjustable drill template mounted to various cabinet doors and drawers for orienting proper positioning of bores to be drilled in the underlying door and drawer structure.

As such, it may be appreciated that there continues to be a need for a new and improved adjustable bolt circle layout apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of layout tool apparatus now present in the prior art, the present invention provides an adjustable bolt circle layout apparatus wherein the same is arranged for simultaneously providing a bolt circle pattern relative to a central axis. As such, the general purpose of the present invention, which will be described subsequently in greater detail, is to provide a new and improved adjustable bolt circle layout apparatus which has all the advantages of the prior art layout tool apparatus and none of the disadvantages.

To attain this, the present invention provides an apparatus including a base plate, with a series of convex slots oriented in a clockwise array through the base plate, and a top plate including a clockwise array of concave slots, wherein the convex slots and concave slots are each of a predetermined number and each pair of overlying concave and convex slots includes a layout spool interconnecting the slots, wherein the spools are directed radially, interiorly, and outwardly of a central opening within the base plate and top plate. A graduated clamp ring mounted to the base plate is positioned exteriorly of the top plate, with a central knob mounted to the top plate to effect rotation of the top plate relative to the base plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art Who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable bolt circle layout apparatus which has all the advantages of the prior art layout tool apparatus and none of the disadvantages.

It is another object of the present invention to provide a new and improved adjustable bolt circle layout apparatus which may be easily and efficiently manufactured and marketed.

It is a further object of the present invention to provide a new and improved adjustable bolt circle layout apparatus which is of a durable and reliable construction.

An even further object of the present invention is to provide a new and improved adjustable bolt circle layout apparatus which is susceptible of a low cost of manufacture with regard to both materials and labor, and which accordingly is then susceptible of low prices of sale to the consuming public, thereby making such adjustable bolt circle layout apparatus economically available to the buying public.

Still yet another object of the present invention is to provide a new and improved adjustable bolt circle layout apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an orthographic top view of the top plate utilized by the invention.

FIG. 3 is an orthographic side view of the top plate.

FIG. 4 is an orthographic top view of the base plate.

FIG. 5 is a partial cross-sectional illustration of the base plate utilized by the instant invention.

FIG. 5*a* is an orthographic view, taken along the lines 5*a*-5*a* of FIG. 4 in the direction indicated by the arrows.

FIG. 6 is an orthographic top view of the clamp ring utilized by the invention.

FIG. 7 is an orthographic side view of the clamp ring utilized by the invention.

FIG. 8 is an orthographic top view of the assembled construction of the invention.

FIG. 9 is an orthographic side view of the invention as set forth in FIG. 8.

FIG. 10 is an orthographic top view of the rotary knob utilized by the invention.

FIG. 11 is an orthographic side view of the rotary knob utilized by the invention.

FIG. 12 is an orthographic cross-sectional illustration of the rotary knob.

FIG. 13 is an orthographic side view of one of the set of locating spools utilized by the invention.

FIG. 14 is an orthographic top view of the locating spool as set forth in FIG. 13.

DESCRIPTION OF THE PREFERRED EMBODIMENT

Figure 1:
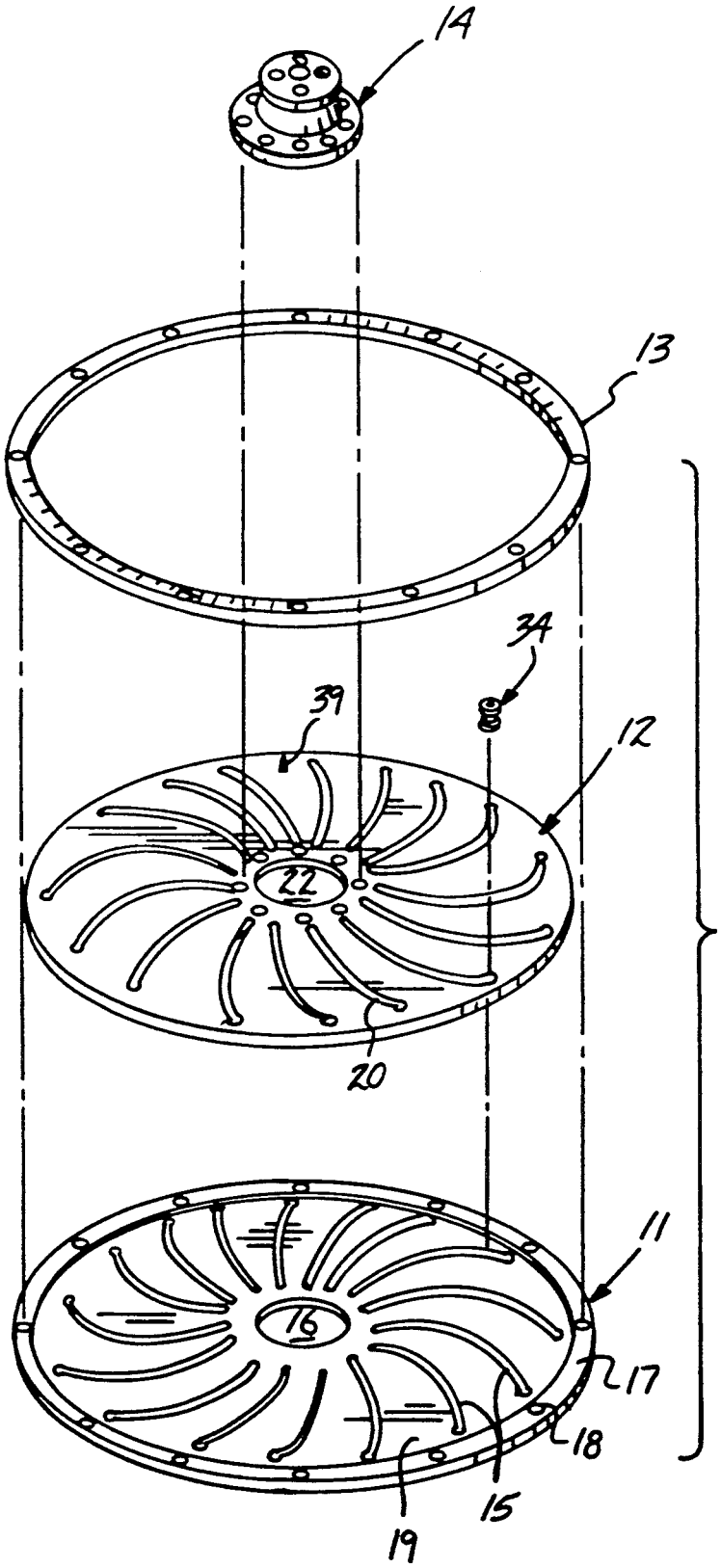
FIG. 1 is an isometric exploded view of the invention.

With reference now to the drawings, and in particular to FIGS. 1 to 14 thereof, a new and improved adjustable bolt circle layout apparatus embodying the principles and concepts of the present invention and generally designated by the reference numeral 10 will be described.

More specifically, the adjustable bolt circle layout apparatus 10 of the instant invention essentially comprises a cylindrical base plate disc 11 mounting a cylindrical top plate disc 12 pivotally and coaxially to a top surface of the base plate 11. A torroidal clamp ring 13 is fixedly mounted to an outer perimeter edge of the base plate disc 11, with a central rotary knob 14 fixedly mounted to the top plate disc 12. The base plate disc 11 includes a series of spaced convex arcuate first slots of a "T" shaped cross-sectional configuration, as illustrated in FIG. 5*a*, that are through-extending the base plate disc 11. The convex first slots are convex as presented in a clockwise array through the base plate disc 11. A base plate central opening 16 is coaxially directed through-extending the base plate discs 11 defined by a predetermined diameter. An outer flange 17 projecting upwardly of the base plate 16 includes a series of outer flange threaded apertures spaced apart a predetermined spacing, with the first slots 15, as illustrated, directed through the base plate's central portion 19 defined interiorly of the flange 17.

The cylindrical top plate disc 12 includes an annular array of concave second slots 20 through-extending the top plate disc 12 as are presented in a clockwise array through the top plate disc 12. A predetermined number of first slots 15, as well as an equal predetermined number of second slots 20 are provided with the slots spaced apart at equal predetermined spacings. Accordingly, a single first slot of the first slots 15 is arranged with a cooperating single slot of the second slots 20 to define pairs of slots. A pair of such slots is illustrated in cooperation in FIG. 8. Each pair of slots includes a locating spool 34 directed through each pair of slots. Each locating spool 34 includes a lower spool flange 35 defined by a first diameter, as well as an upper spool flange 36 of an equal first diameter, with a central cylindrical body 37 of a second diameter less than the first diameter. The first slots 15 of the "T" shaped configuration define an upper opening 15*a* of the second diameter, and a lower opening 15*b* of the first diameter to slidably receive and capture the lower spool flange 35 and the central spool body 37 therewithin. The central spool body 37 projects upwardly through the associated slot 20 of an associated second slot defined by a width substantially equal to the second diameter to receive the central spool body 37 therethrough, with the upper spool flange 36 positioned to a top surface of a cylindrical top plate disc 12. The base plate disc central portion 19 and the top plate disc 12 are each of a predetermined thickness equal to a predetermined height of the central spool body 37.

The top plate disc 12 further includes an annular array of mounting apertures 21 arrayed about the top plate central opening 22 that is coaxial with and of an equal predetermined diameter to that of the base plate central opening 16. The clamp ring 13 includes a series of clamp ring apertures 23 directed therethrough spaced apart the equal predetermined spacing defined by the threaded apertures 18 of the base plate to receive a first fastener through respective aligned pair of a threaded aperture 18 and associated clamping aperture 23. A graduated interior flange 24 is positioned above the base plate's central portion 19 to capture the top plate therebetween. The graduated interior flange 24 cooperates with a top plate pointer indicia 39 to provide angular orientation or rotation of the top plate relative to the base plate to indicate a resultant belt circle diameter.

The central rotary knob 14 is secured to the top plate by second fasteners 26 directed through annular flange openings 29 of an annular flange 28 of the rotary knob that is positioned above the cylindrical lower body 27 defined by a predetermined height equal to the predetermined thickness of the base plate disc 11 and the top plate disc 12. In this manner, the rotary knob includes a cylindrical upper body 30 projecting above the annular flange 28 for manual grasping and rotation of the central rotary knob 14 and the associated top plate disc 12. A central knob bore 32 permits reception of a locating pin 33 therethrough for positioning the apparatus relative to any underlying surface.

Upon rotation of the top plate disc 12 relative to the base plate disc 11 the locating spools 34 are radially interiorly or exteriorly relative to the axial center of the assembled apparatus to provide location of a bolt circle spacing equal to a number defined by the number of pairs of first and second slots.

Further, locating pins 40 are conveniently mounted within the rotary knob 14 within an associated locating pin bore 41, wherein the locating pins 40 may be positioned within a desired number of the locating spools 34 through an associated central body bore 38 of each locating spool. The central body 38 permits directing of a marking instrument or locating pin, whereupon a workpiece whose outside diameter is to be gauged may be positioned coaxially relative to the rotary knob 14 with the locating spools 34 thereafter directed radially inwardly relative to the rotary knob until the locating pins 40 projecting below a bottom surface of the base plate disc 11 engages an exterior surface of such a workpiece in use.

Further in use, the locating pin 33 may be aligned with a desired axial center for providing desired radial positioning of desired pairs of the locating spools 34 for providing marking to an underlying workpiece of a desired full circle radius.

FIG. 13 further illustrates the use of a marking tool "T" that is directed through each locating spool, whereupon proper orientation of the locating spool within the apparatus, the marking tool "T" is projected through the desired number of locating spools equal to a desired bolt pattern for marking of an underlying surface in a workpiece (not shown).

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable bolt circle layout apparatus, comprising, a cylindrical base plate disc, the base plate disc including a base plate central portion, with an outer flange extending upwardly about an outer perimeter of the base plate central portion, and a base plate central opening directed coaxially of the cylindrical base plate disc, and the base plate central portion including a predetermined number of convex arcuate first slots defining an array spaced apart a predetermined equal spacing, wherein the first slots are in a convex configuration as presented in a clockwise array throughout the base plate central portion, and the first slots are defined by a predetermined number of first slots, and a cylindrical top plate disc pivotally mounted to a top surface of the cylindrical base plate disc, wherein the cylindrical top plate disc includes a top plate central opening coaxially aligned with the base plate central opening, and the top plate disc including a plurality of concave second slots defined equal to the predetermined number extending through the top plate disc, wherein the second slots are concave as presented in a clockwise array through the top plate disc, and each first slot of said first slots is operatively associated with a companion second slot of said plurality of second slots to define a slot pair to define a predetermined number of slot pairs, and each slot pair includes a locating spool directed through each slot pair, whereupon rotation of the top plate disc relative to the base plate disc effects radial simultaneous displacement of the spools relative to an axial center defined by the coaxially aligned base plate central opening and the top plate central opening, and the base plate central portion and the top plate disc are each defined by a thickness equal to a predetermined thickness, and each spool includes a lower spool flange defined by a first diameter, a central spool body of a cylindrical configuration defined by a second diameter, and an upper spool flange defined by the first diameter, wherein the upper spool flange extends above the top plate disc, and the first slot is of a "T" shaped cross-sectional configuration including an upper slot opening defined by a width equal to the second diameter, and a lower slot opening defined by a further width equal to the first diameter, wherein each lower opening of each first slot slidably receives associated lower spool flange of each associated spool.

2. An apparatus as set forth in claim 1 including a clamp ring, the clamp ring defined by a torroidal configuration and including a plurality of clamp ring openings, the base plate outer flange includes outer flange threaded apertures directed into the outer flange, wherein each threaded aperture of said threaded apertures is aligned with a clamp ring opening of said clamp ring openings to receive a first fastener to secure the clamp ring to the outer flange, and the clamp ring includes a graduated interior flange extending over the cylindrical top plate disc, the graduated interior flange is cooperative with a top plate pointer indicia mounted to a top surface of the top plate disc to indicate degrees of rotation of the top plate disc relative to the base plate disc.

3. An apparatus as set forth in claim 2 including a central rotary knob fixedly mounted to the top plate disc.

4. An apparatus as set forth in claim 3 wherein the rotary knob includes a cylindrical lower body defined by a predetermined height equal to twice the predetermined thickness to extend complementarily within the base plate central opening and the top plate central opening, and the top plate includes top plate mounting apertures in an annular array about the top plate central opening, and the rotary knob includes a rotary knob flange extending radially outwardly of the cylindrical lower body the rotary knob flange includes annular flange openings, wherein the annular flange openings are aligned with the top plate top plate mounting apertures to receive second fasteners to fixedly secure the rotary knob to the top plate disc.

5. An apparatus as set forth in claim 4 wherein the rotary knob includes a central bore extending coaxially therethrough, wherein the central bore is coaxially aligned with the base plate central opening and the top plate central opening and the central bore is defined by a central bore diameter, and further including a locating pin defined by an external diameter equal to the central bore diameter to complimentarily position the locating pin through the central bore to permit locating and positioning of the central bore relative to an underlying workpiece.

6. An apparatus as set forth in claim 4 wherein each locating spool includes a locating spool bore coaxially directed coextensively throughout the locating spool to permit projection of a marking tool through each spool.

* * * * *